United States Patent [19]

Schepergerdes

[11] Patent Number: 4,914,933

[45] Date of Patent: Apr. 10, 1990

[54] INSTALLATION AND SWAGING TOOL FOR INSERTS

[75] Inventor: Wilhelm F. Schepergerdes, El Toro, Calif.

[73] Assignee: Rexnord Holdings Inc., Torrance, Calif.

[21] Appl. No.: 251,127

[22] Filed: Sep. 29, 1988

[51] Int. Cl.[4] ..... B21D 41/02

[52] U.S. Cl. ..... 72/114; 72/391

[58] Field of Search ..... 72/114, 391

[56] References Cited

U.S. PATENT DOCUMENTS

| | | | |
|---|---|---|---|
| 3,462,988 | 8/1969 | Tudor et al. | 72/114 |
| 3,472,052 | 10/1969 | Chance | 72/114 |
| 3,665,581 | 5/1972 | Gulistan | 72/391 |
| 4,402,203 | 9/1983 | Molina | 72/114 |

OTHER PUBLICATIONS

Rexnord Instruction Manual CWS-SR[ ]A Series Combination Wrench And Swage Tool, Non-Impact For Rosan Slimsert Inserts TSB 76-724B.

*Primary Examiner*—Lowell A. Larson

*Attorney, Agent, or Firm*—Pretty, Schroeder, Brueggemann & Clark

[57] ABSTRACT

An installation and swaging tool for installing and swaging a portion of an insert into a parent material, includes a drawbar having an end for carrying an insert. A moveable swaging member is disposed about and guided longitudinally by the drawbar for swaging an insert at the end of the drawbar. A sleeve and other moving means are provided for moving the swaging member longitudinally along the drawbar, wherein the sleeve comprises a guide surface for moving relative to the drawbar. A pin is placed between the drawbar and the guide surface for limiting the relative magnitude of displacement between the drawbar and the sleeve.

6 Claims, 4 Drawing Sheets

INSTALLATION AND SWAGING TOOL FOR INSERTS

BACKGROUND

1. Field of Invention

This invention relates to non-impact tools for installing and swaging inserts in a base material, and more specifically to such tools for installing and swaging threaded inserts into a parent material.

2. Related Art

Threaded inserts are used extensively in housings or mounts for various equipment when the material from which the housing or mount is formed is incapable of withstanding the forces that would be brought to bear when a fastener is placed in a tapped hole in the housing or mount. The insert is threaded into a tapped hole in the housing or mount and swaged so that a portion of the insert engages the parent material, thereby preventing the insert from rotating or backing out of the material due to vibration or other external forces.

Swaging is accomplished by expanding at least a portion of the insert outwardly into the parent material. This may be accomplished by a cylindrically shaped anvil mounted in a hydraulic press or in a handtool having handles operated much like a pair of pliers. Alternatively, swaging can be accomplished by striking the anvil mounted on a shaft with a mallet or hammer. The hydraulic apparatus for swaging the inserts is typically automated or requires costly machinery. This type of machinery is too complex and expensive for infrequent-type repair work where a broken insert is removed and replaced by a new insert. The plier-type handtool, while convenient and simple to use, sometimes develops too much force when the technician squeezes the tool too much. Use of a mallet or hammer developes too much of an impact force on the insert and often damages the parent material.

SUMMARY OF THE INVENTION

In order to provide an improved installation and swaging tool, a tool for swaging a portion of an insert into a parent material includes a shaft member extending longitudinally and having an end for holding an insert at the end. A moveable swaging member is disposed about and guided longitudinally by the shaft member for swaging an insert at the end of the shaft member. Moving means are provided for moving the swaging member longitudinally along the shaft member, wherein the moving means comprises a guide surface for moving relative to the shaft member. Limit means are provided between the shaft member and the guide surface for limiting the relative magnitude of displacement between the shaft member and the moving means. The limit means may be a pin fixed to the shaft member for engaging corresponding stop surfaces on the moving means such that the moving means moves only a limited distance between the two stop surfaces.

The moving means may be a sleeve oriented about the shaft member and driven axially through a thrust bearing by a screw element, as part of the moving means, threaded into one portion of the shaft member. Threading of the screw element into the shaft member advances the sleeve so that the swaging member can swage the insert. Displacement of the sleeve, and therefore the amount of swaging, is limited by the pin contacting one stop surface on the sleeve.

The tool may include a cylindrical body, one end of which includes wrenching flats for holding the body while the screw element is being threaded into the holding means. The body is fixed to the holding means by the pin. Therefore, the body can be used to install the insert into the parent material, once the insert is mounted to the end of the holding means, simply by turning the body of the tool.

The other end of the body includes an end surface for contacting the parent material after the insert has been installed into the parent material a sufficient amount. The tool is designed such that the insert is recessed into the parent material a predetermined amount when the end surface of the body makes contact with the parent material.

DETAILED DESCRIPTION OF THE PREFERRED EMBODIMENT

Figure 1:
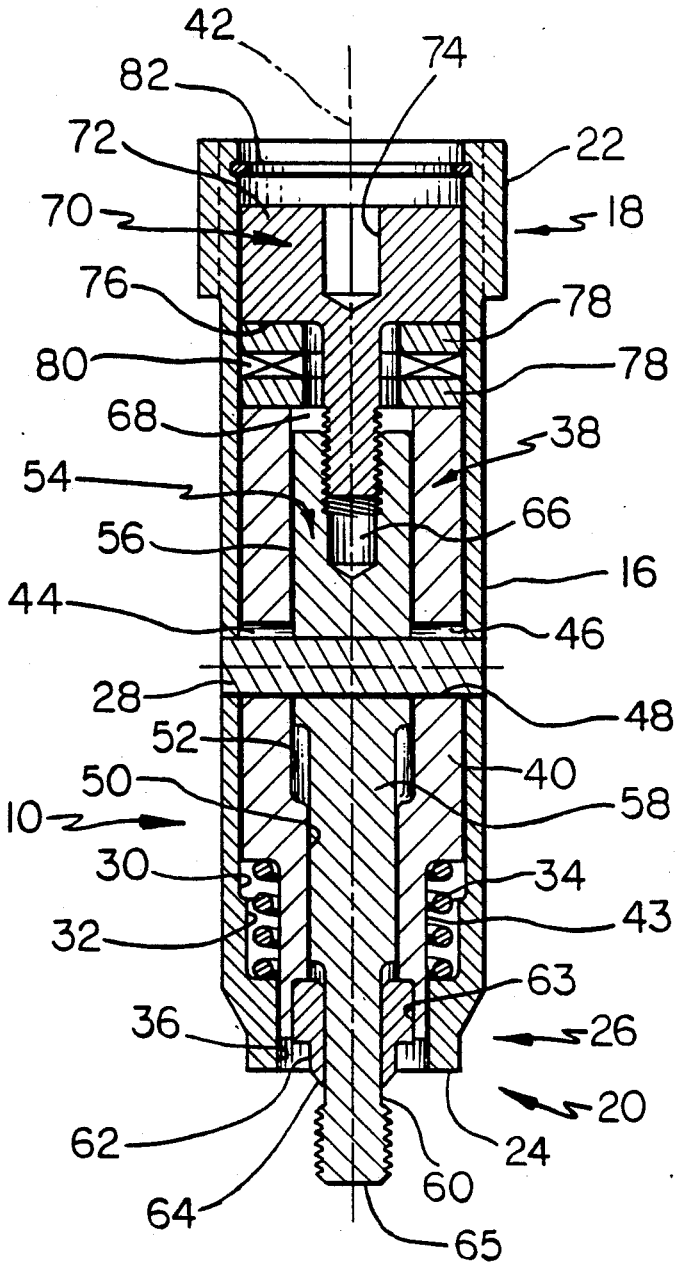
FIG. 1 is a side sectional view of an installation and swaging tool in its retracted configuration according to the present invention.
Figure 3:
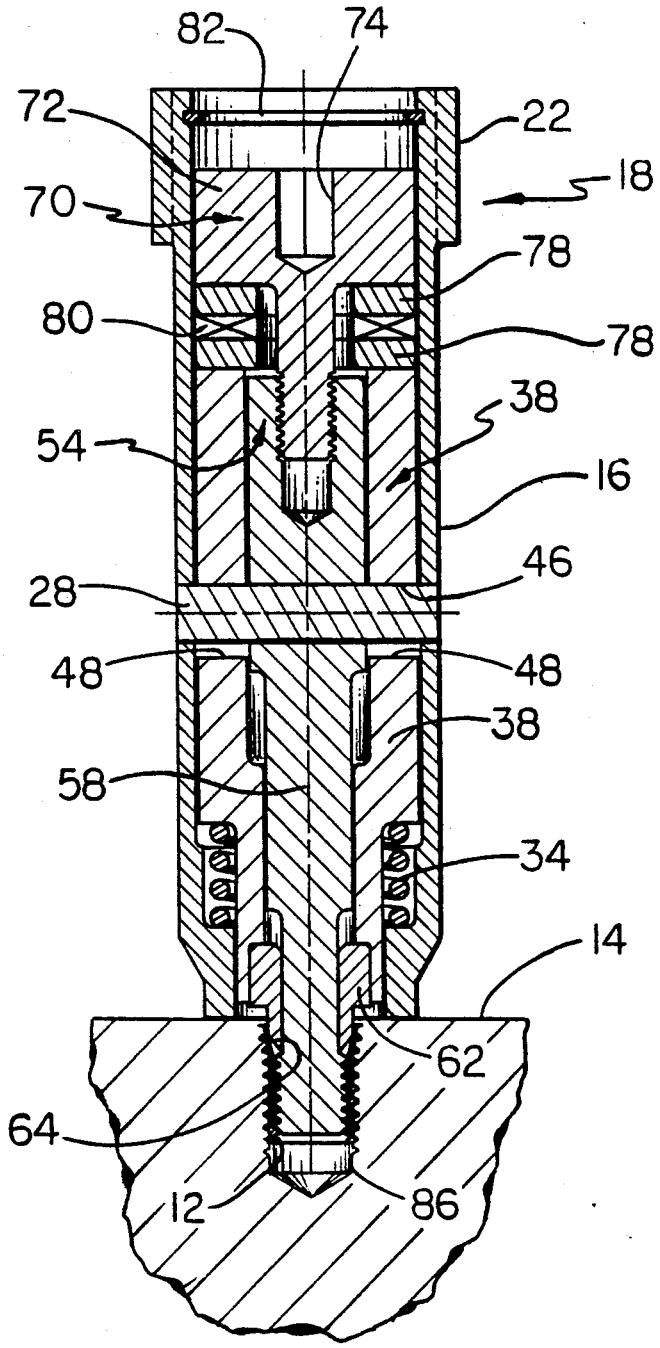
FIG. 3 is a side sectional view of the tool and insert of FIG. 2 after the insert has been threaded into a parent material and swaged.
Figure 4:
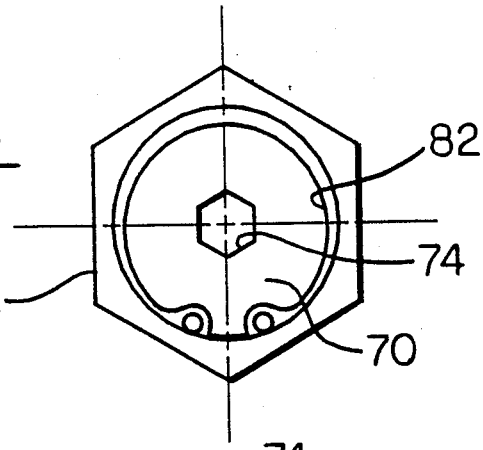
FIG. 4 is a top plan view of the swaging tool of FIG. 1.

An installation and swaging tool 10 (FIG. 1) is used for installing an insert 12 and swaging a portion of the insert into a parent material 14 of a housing or mount (discussed more fully below with respect to FIG. 3). The tool includes a body 16 having first and second ends 18 and 20, respectively, wherein the first end has means for rotating the body in the form of wrenching flats or hex surfaces 22 or other suitable means by which a wrench can be applied to the body for rotating the tool. The second end 20 includes an end surface 24 for contacting the parent material when the insert is threaded into the parent material the desired amount for installation. The body is generally cylindrical in configuration except for the wrenching flats on the first end and a tapered or reduced section 26 at the second end for minimizing the outside diameter of the tool at the point closest to the parent material. This allows the tool to access portions of a housing for installing the insert where there is little excess work space.

The body includes a pair of diametrically opposed holes in the cylindrical wall to accept a pin 28 which forms part of the limit means or stop means for limiting the relative magnitude of displacement between the shaft member and the moving means, described more fully below. The body includes a circular bore 30 extending a substantial length of the body and terminating in a reduced diameter bore 32 for accommodating a coil compression spring 34. The reduced diameter bore in turn terminates in a throat section 36 beginning approximately at the portion of the body where the taper 26 begins.

The throat section 36 surrounds and guides one end of a sleeve 38. The sleeve is axially movable relative to the body for moving toward the second end 20 of the body. The sleeve includes a cylindrical wall 40 having an outside diameter slightly less than the inside diameter of the circular bore 30 of the body so that the sleeve can slide axially inside the body and along a central axis 42. The sleeve terminates in a necked down portion 43 having an outside diameter slightly less than the inside diameter of the throat section 36 so that the sleeve can slide axially within the throat section. The necked down portion extends from the lower end of the sleeve along the length of the sleeve sufficiently to accommodate the compression spring between the necked down portion and the reduced diameter bore of the body. The compression spring biases the sleeve in a direction away from the throat section 36.

Axial travel of the sleeve is limited by the presence of the pin 28 passing through a pair of diametrically opposed circular sleeve holes 44 formed in the cylindrical wall 40. The wall of each hole defines first and second stop surfaces 46 and 48, respectively, which contact respective surfaces on the pin. The second stop surface 48 along with the pin limits the reverse or retractive axial movement of the sleeve relative to the drawbar in response to the bias of the compression spring 34. The first stop surface 46 and the pin 28 limit the forward axial movement or displacement of the sleeve relative to the drawbar against the bias of the compression spring. In the preferred embodiment, the outside diameter of the pin is significantly less than the inside diameter of the circular sleeve holes 44. The difference between the outside diameter of the pin and the inside diameters of the sleeve holes 44 defines a predetermined amount of relative movement between the sleeve and the pin, and, therefore, between the sleeve and the body. The holes 44 are preferably circular, but other configurations are possible.

The sleeve 38 includes a first wall defining a bore 50 and a second, larger diameter wall defining a counterbore 52. The bore 50 and the counterbore 52 allow the sleeve to fit around and move axially relative to correspondingly dimensioned portions of a shaft member or drawbar 54 extending within and coaxial with the sleeve. The bore 50 defines a guide surface allowing the sleeve to move relative to the drawbar.

The drawbar 54 includes a first upper portion 56 along which the upper portion of the sleeve 38 slides. The length of the upper portion is less than the length of the sleeve counterbore 52 so that the sleeve can slide axially along the drawbar without interference from the wider, upper portion of the drawbar. The drawbar includes a middle portion 58 having a reduced outside diameter slightly less than the inside diameter of the sleeve bore 50 to allow the sleeve to slide axially along the drawbar. The middle portion terminates in a neck portion 60 having an outside diameter less than that of the middle portion for slidably accepting a swage anvil 62 which is formed from two mirror-image halves press-fitted into a counterbore 63 in the lower end of the sleeve 38. When the two halves are combined as a single unit, the swage anvil 62 includes a first portion having a diameter slightly larger than the inside diameter of the counterbore 63 of the sleeve so that the swage anvil is press-fitted into the counterbore. The outside diameter of the swage anvil reduces to a second cylindrical portion terminating in a conical portion 64, which is the surface on the swage anvil which initially contacts the insert and begins the swaging process. The conical section may form a single angle with respect to the central axis 42 or may be split into two or more angles or transitions in order to facilitate the swaging process.

Figure 2:
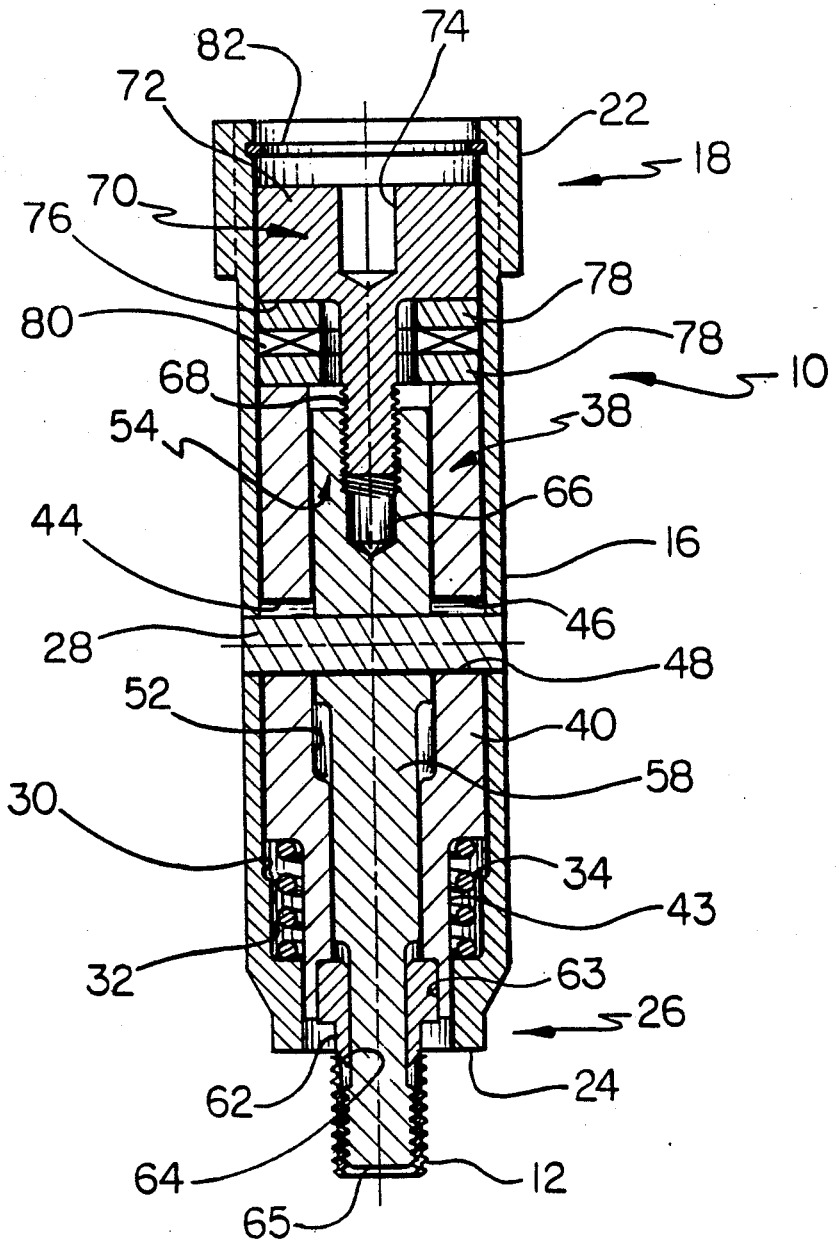
FIG. 2 is a side sectional view of the swaging tool of FIG. 1 showing an insert positioned at the end of the tool prior to installation in a parent material.

The neck portion 60 of the drawbar is long enough to allow the swage anvil 62 to slide along the length thereof without contacting either end of the neck portion when the pin 28 is in place. The drawbar terminates in an end 65 for supporting or carrying an insert, such as the conventional insert 12 (FIGS. 2 and 3) which is to be installed and swaged in a parent material. The end 65 may be threaded for accepting an internally threaded insert or may have other means for holding an insert depending on the configuration of the insert being installed and swaged.

Figure 5:
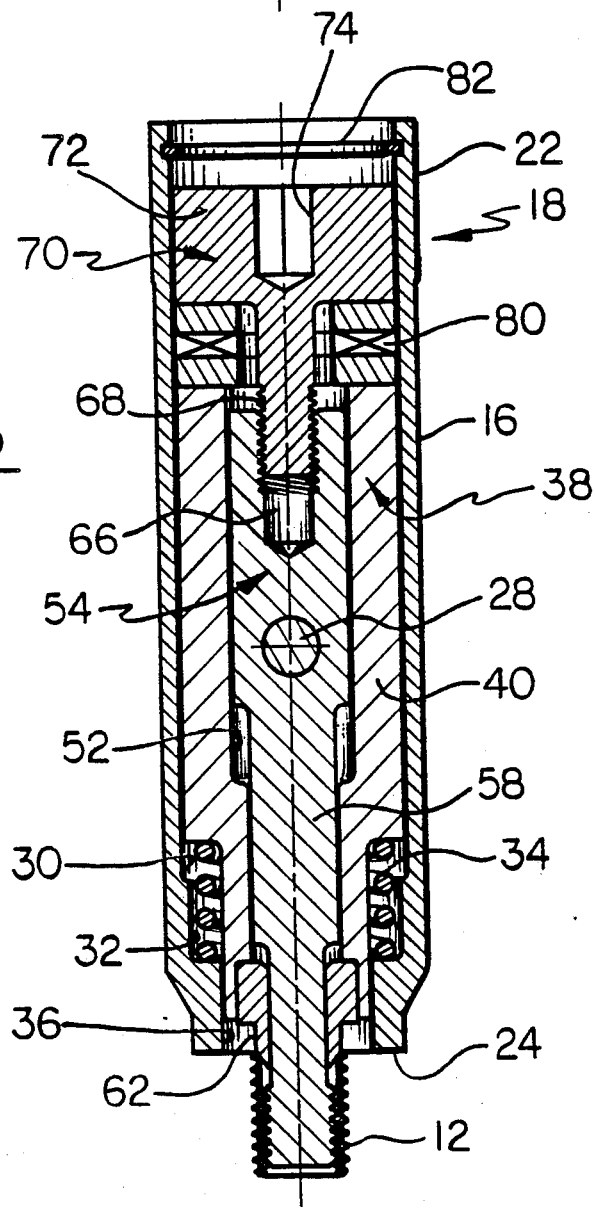
FIG. 5 is a side sectional view of the swaging tool of FIG. 2 taken along a plane perpendicular to that of FIG. 2.

The drawbar includes a diametrically transverse bore (FIGS. 1 and 5) extending through the upper portion of the drawbar along an axis for accommodating the pin 28. The pin thereby fixes the drawbar and the body both axially and rotationally with respect to each other. The upper portion of the drawbar includes a threaded bore 66 for coacting with a correspondingly threaded shaft 68 of a drive element in the form of a screw 70. The threads are formed so as to optimize the torque necessary to move the sleeve for swaging the insert. Preferably, the torque necessary is minimized.

The screw 70 includes a screwhead 72 having a diameter slightly less than the inside diameter of the circular bore 30 of the body so that the screw can rotate and move axially within the bore. The screwhead includes a hex socket 74 or other means for accepting a wrench or other tool for turning the screw relative to the body.

The lower surface of the screwhead forms a bearing surface 76 for bearing down on a pair of thrust washers 78 sandwiching a thrust bearing 80. The thrust bearing and thrust washers transfer the axial load developed by advancement of the screw to the sleeve so that the sleeve moves axially relative to the body and to the drawbar. The sleeve 38, screw 70, thrust washer 78, thrust bearing 80 and the threaded engagement between the screw and the drawbar form means for moving the swage member 62 longitudinally along the drawbar. Advancement of the screw into the upper end of the drawbar advances the swage anvil toward the end 65 of the drawbar. Retraction of the screw moves the swage anvil away from the end of the drawbar.

A retaining ring 82 is placed in the upper portion of the circular bore 30 to retain the internal components of the tool.

The tool is assembled by first placing the drawbar inside the sleeve until the upper portion of the drawbar reaches the bottom of the sleeve counterbore 52. In this configuration, the neck portion 60 extends far enough out of the sleeve 38 to allow the two halves of the swage anvil to be placed around the neck portion and press-fitted into the counterbore 63 of the sleeve. The thrust washers and thrust bearings are then placed on top of the sleeve and the screw 70 threaded into the end of the drawbar. The spring 34 is placed in the reduced diameter bore 32 and the assembly of the sleeve and drawbar placed over the spring. The retaining ring 82 may then be installed and the pin 28 passed through the openings in the wall of the body, the holes in the sleeve and the bore in the drawbar to fix the drawbar with respect to the body.

A threaded insert 12 may then be threaded onto the end 65 of the drawbar. The insert shown in FIG. 2 includes internal and external threads. The insert is threaded onto the end of the drawbar until the top of the insert contacts the conical portion 64 of the swage anvil 62. The number of turns necessary to make contact depends primarily on the dimensions of the swage anvil and the sleeve. The spring 34 ensures that the sleeve is sufficiently withdrawn into the body as long as the screw 70 is backed off sufficiently. The second stop surface 48 determines the extent of retraction of the sleeve into the body. It should be noted that the length of the lower portion of the neck 60 should be sufficient to allow complete swaging of the insert before the foremost tip of the swage anvil contacts the threads on the end of the drawbar. In the preferred embodiment, advancement of the sleeve will be stopped by the pin 28 prior to the anvil contacting the threads on the drawbar. Conversely, the length of the neck portion 60 should be short enough to maximize the thread engagement of the end of the drawbar with the insert.

The end surface 24 of the body is located, relative to the upper end of the insert when fully engaged with the drawbar, such that the insert is recessed into the parent material the desired amount when the end surface contacts the parent material.

In the preferred embodiment, the internal diameter of the holes in the cylindrical wall of the body is less than the outside diameter of the pin 28 so that the pin is press fitted in the body. The outside diameter of the pin in turn is less than the inside diameter of the transverse bore in the drawbar. This fixes the pin in the body and provides some tolerance as the pin is passed through the bore of the drawbar to ease complete assembly.

In operation, an insert 12 is threaded onto the end 65 of the drawbar 54 until the top of the insert contacts the swage anvil 62. Immediately prior to threading into the parent material, the insert and the installation and swaging tool will be in the configuration shown in FIG. 2. Specifically, the screw 70 will be withdrawn sufficiently to allow the spring 34 to bias the sleeve 38 rearward so that the second stop surfaces 48 will be in contact with the pin 28. The insert is then threaded into a tapped bore 86 in the parent material 14 until the end surface 24 of the tool makes contact with the top surface of the parent material. The insert may be threaded into the parent material either by rotating the assembly by hand or by rotating the assembly using a wrench on the wrenching flats 22. The insert is installed in the parent material to the required depth so that the insert is recessed below the surface of the parent material. The screw may be retracted more than is necessary but it is still retained within the bore of the body by the retaining ring 82.

Swaging of the insert can be done with a power tool or by hand. Swaging is accomplished by holding the body 16, and therefore the drawbar 54 using a wrench on the wrenching flats 22 of the body. A hex wrench is inserted into the socket 74 and used to thread the screw 70 into the drawbar 54. Advancement of the screw 70 pushes the sleeve and therefore the swage anvil forward against the bias of the spring and against the counterforce developed in the insert while it is being swaged. Swaging continues as the screw is tightened down into the drawbar until such time as the first stop surfaces 46 in the sleeve contact the corresponding curved surfaces of the pin. The pin and the second stop surfaces prevent further swaging of the insert even if further swaging could be accomplished but for the presence of the pin. This protects the insert and the parent material from any damage due to excessive swaging or the development of excessive forces in the parent material. The configuration of the tool is then as shown in FIG. 3 where the upper portion of the insert is fully swaged into the parent material.

To remove the tool, the screw 70 is retracted, thereby retracting the swage and sleeve until the second stop surfaces 48 contact the pin 28. The entire tool can then be rotated by rotating the body in order to disengage the end of the drawbar from the threaded insert. The tool is then ready for further use.

The spring serves several purposes. First, the spring biases the sleeve rearward with unthreading of the screw 70. The spring holds the sleeve against the pin 28 so that the sleeve and therefore the anvil is fully retracted when a new insert is threaded onto the end of the drawbar.

Use of the body along with the sleeve and drawbar allows for installation of the insert to the required depth in the parent material without requiring a guage or a visual check to confirm the insert depth.

The tool does not develop excessively high torque when driven either by hand or using an automatic drive because of the presence of the transverse pin limiting longitudinal movement of the sleeve and swage. The tool also provides for gradual application of a lower force than would be applied with an impact type of swage.

It should be noted that the above is a preferred configuration, but others are foreseeable. The described embodiment of the invention is only considered to be preferred and illustrative of the inventive concepts. The scope of the invention is not to be restricted to such embodiment. Various and numerous other arrangements may be devised by one skilled in the art without departing from the spirit and scope of the invention.

I claim:

1. A tool for swaging a portion of a threaded insert into a base material, the tool comprising:

a shaft member extending longitudinally and having a thread end for holding an insert at the end;

movable swage means split into at least two portions and disposed about and guided by the shaft member for swaging into the base material the top of an insert held on the end of the shaft member;

retaining means for retaining the movable swage means about the shaft during normal operation and wherein the swage means are removable from the retaining means and removable from the shaft by separating the split portions;

a first threaded member fixed relative to the shaft member;

moving means for moving the movable swage means relative to the shaft member wherein the moving means moves relative to the first threaded member through threaded engagement with the first threaded member;

a second member longitudinally fixed relative to the shaft member and including a stop surface;

transmission means for transmitting movement of the moving means to the movable swage means and including a transmission means stop surface wherein the transmission means stop surface contacts the stop surface on the second member after movement of a predetermined amount thereby stopping further swaging of the insert by the swage means;

a body for enclosing and retaining at least a substantial portion of the shaft member, the first threaded member and the moving means, and having a first end wherein the first end includes means for rotating the body; and an end surface between a second end portion on the body and the threaded end on the shaft member for contacting the base material and for use in determining when the insert is sufficiently inserted into the base material.

2. The tool of claim 1 wherein the retaining means includes a wall defining an enclosure forming a frictional engagement with the movable swage means.

3. The tool in claim 2 wherein the first threaded member is integral with the shaft member such that movement of the moving means includes threading of the moving means into the shaft member.

4. The tool of claim 3 wherein the second member longitudinally fixed relative to the shaft member includes a transversely extending round pin.

5. The tool of claim 3 wherein the rotating means on the first end of the body includes external surfaces for engagement with a tool for turning the body and wherein turning the body threads the insert relative to the base material.

6. The tool of claim 5 wherein the end surface is formed on a second end of the body.

* * * * *